US010294930B2

(12) United States Patent
Bahar

(10) Patent No.: US 10,294,930 B2
(45) Date of Patent: May 21, 2019

(54) ELECTROCHEMICAL SYSTEM WITH REAL TIME MODIFICATION OF COMPOSITION AND USE OF COMPLEX WAVE FORM IN SAME

(71) Applicant: Xergy Inc, Georgetown, DE (US)

(72) Inventor: Bamdad Bahar, Georgetown, DE (US)

(73) Assignee: Xergy Inc., Harrington, DE (US)

( * ) Notice: Subject to any disclaimer, the term of this patent is extended or adjusted under 35 U.S.C. 154(b) by 592 days.

(21) Appl. No.: 14/630,659

(22) Filed: Feb. 25, 2015

(65) Prior Publication Data

US 2015/0241091 A1 Aug. 27, 2015

Related U.S. Application Data

(60) Provisional application No. 61/966,566, filed on Feb. 25, 2014.

(51) Int. Cl.

| | |
|---|---|
| ***F04B 1/00*** | (2006.01) |
| ***F04B 37/02*** | (2006.01) |
| ***F04B 19/20*** | (2006.01) |
| ***F04B 37/00*** | (2006.01) |
| ***F25B 1/00*** | (2006.01) |
| *C25B 1/02* | (2006.01) |

(52) U.S. Cl.
CPC ..... *F04B 37/02* (2013.01); *F04B 19/20* (2013.01); *F04B 37/00* (2013.01); *F25B 1/00* (2013.01)

(58) Field of Classification Search
CPC ..... F04B 19/20; F04B 37/00; F04B 37/02; F25B 1/00
See application file for complete search history.

(56) References Cited

U.S. PATENT DOCUMENTS

| | | | | |
|---|---|---|---|---|
| 4,593,534 A * | 6/1986 | Bloomfield | ..... | F25B 1/00 417/48 |
| 5,024,060 A * | 6/1991 | Trusch | ..... | F25B 9/02 417/48 |
| 2002/0066277 A1* | 6/2002 | Tsenter | ..... | F04B 35/00 62/46.2 |

(Continued)

OTHER PUBLICATIONS

Bamdad Bahar. Advanced Hybrid Water-Heater Using Electrochemical Compression (ECC). Presentation, Apr. 2015. (Year: 2015).*

*Primary Examiner* — Steven A. Friday
(74) *Attorney, Agent, or Firm* — Invention to Patent Services; Alex Hobson

(57) ABSTRACT

An electrochemical system having an electrochemical compressor with an operating voltage that is controlled by a controller is described. The operating voltage between a first and second electrodes separated by an ion conducting material, such as a proton conducting polymer, may be oscillated in a waveform. The controller may reduce the voltage to low pressure side of the electrochemical compressor to initiate electrolysis for a set time interval and then may change the operating voltage to operate the electrochemical cell in a compressor mode. When the electrochemical cell is operating in an electrolysis mode, in situ hydrogen is produced on the low pressure side that may be used as a electrochemically active component of the working fluid when the electrochemical cell is switched to a compressor mode. The controller may have a control program that automatically controls the operating waveform as a function of sensor input.

5 Claims, 4 Drawing Sheets

(56) References Cited

U.S. PATENT DOCUMENTS

| | | | | |
|---|---|---|---|---|
| 2010/0132386 | A1* | 6/2010 | Bahar | F25B 1/00 62/115 |
| 2011/0127018 | A1* | 6/2011 | Bahar | F25B 1/00 165/121 |
| 2011/0198215 | A1* | 8/2011 | Bahar | C09K 5/041 204/241 |
| 2013/0039779 | A1* | 2/2013 | Bahar | F04B 19/20 417/48 |
| 2014/0027304 | A1* | 1/2014 | Bahar | C25B 1/02 205/637 |

* cited by examiner

ELECTROCHEMICAL SYSTEM WITH REAL TIME MODIFICATION OF COMPOSITION AND USE OF COMPLEX WAVE FORM IN SAME

CROSS REFERENCE TO RELATED APPLICATIONS

This application claims the benefit of US. provisional patent application No. 61/966,566, filed on Feb. 25, 2014 and entitled Operation Of An Electrochemical System With Real Time Modification Of Composition. And Use Of Complex Wave Form In Same; the entirety of which is incorporated by reference herein.

BACKGROUND OF THE INVENTION

Field of the Invention

The invention is directed to electrochemical systems and particularly electrochemical compressor systems.

Background

The function of refrigeration cycles and heat pumps is to remove heat from a heat source, or reservoir at low temperature, and to reject the heat to a heat sink, or reservoir at higher temperature. While many thermodynamic effects have been exploited in the development of heat pumps and refrigeration cycles, one of the most popular today is the vapor compression approach. This approach is sometimes referred to as mechanical refrigeration because a mechanical compressor is used in the cycle.

Mechanical compressors account for approximately 30% of a household's energy requirements and thus consume a substantial portion of most utilities' base load power. Any improvement in efficiency related to compressor performance can have significant benefits in terms of energy savings and thus have significant positive environmental impact. In addition, there are increasing thermal management problems in electronic circuits, which require smaller heat pumping devices with greater thermal management capabilities.

Vapor compression refrigeration cycles generally contain five important components. The first is a mechanical compressor that is used to pressurize a gaseous working fluid. After proceeding through the compressor, the hot pressurized working fluid is condensed in a condenser. The latent heat, of vaporization of the working fluid is given up to a higher temperature reservoir, often called the sink. The liquefied working fluid is then expanded at substantially constant enthalpy in a thermal expansion valve or orifice. The cooled liquid working fluid is then passed through an evaporator. In the evaporator, the working fluid absorbs its latent heat of vaporization from a low temperature reservoir often called a source, The last element in the vapor compression refrigeration cycle is the working fluid itself.

In conventional vapor compression cycles, the working fluid selection is based on the properties of the fluid and the temperatures of the heat source and sink. The factors in the selection include the specific heat of the working fluid, its latent heat of vaporization, its specific volume and its safety. The selection of the working fluid affects the coefficient of performance of the cycle.

For a refrigeration cycle operating between a lower limit, or source temperature, and an upper limit, or sink temperature, the maximum efficiency of the cycle is limited to the Carnot efficiency. The efficiency of a refrigeration cycle is generally defined by its coefficient of performance, which is the quotient of the heat absorbed from the sink divided by the net work input required by the cycle.

Any improvement in refrigeration systems clearly would have substantial value. Electrochemical energy conversion is considered to be inherently better than other energy conversion systems due to their relatively high exergetic efficiency. In addition, electrochemical systems are considered to be noiseless, modular, scalable and can provide a long list of other benefits depending on the specific thermal transfer application.

SUMMARY OF THE INVENTION

The present invention relates to the application of electrochemical energy conversion systems for use as a compressor, such as in a refrigeration system or heat pump system. An electrochemical refrigeration system is described in U.S. Pat. No. 8,769,972, to Xergy, Inc., which is incorporated by reference herein in its entirety. As described in this patent, the working fluid is composed of two components, the electro-active component, frequently hydrogen, (H2), and a co-working fluid that provides the phase change in the cycle. In modeling, the presence of hydrogen in the system reduces the overall efficiency as compared to the theoretical efficiency for the system utilizing only the phase change component. This invention mitigates that impact by in situ local generation of hydrogen gas by a membrane electrode assembly, (MEA), of the electrochemical compressor, (ECC), and subsequently using this in situ generated hydrogen in a compressor mode. An electrochemical cell comprising one or more membrane electrode assemblies may operate in an electrolysis mode; wherein in situ hydrogen is formed on a low pressure side of the MEA. The operating voltage of the electrochemical cell may then be switched by a controller to operate in a compressor mode, wherein the in situ hydrogen is oxidized to protons for water pumping and compression through the compressor. The oxygen generated on the outlet side of the compressor membrane recombines with the hydrogen generated in normal compressive phase to regenerate water.

In an exemplary embodiment, an electrochemical compressor and heat pump system includes an electrochemical cell and a mixed gas refrigerant-based cooling system. The electrochemical cell is capable of producing high pressure gas from a mixed fluid system including an electrochemically-active component such as hydrogen and at least one refrigerant fluid. An exemplary cooling system may include a condenser, compressor, and evaporator in thermal communication with an object to be cooled. In an exemplary embodiment, a working fluid is pressurized on a high-pressure side of a membrane electrode assembly. The transport or pumping of protons and liquid from the low pressure side to the high-pressure side of the MEA increases the pressure of the working fluid within a conduit. The working fluid enters a gas space, such as a conduit coupled with the high-pressure side of the MEA, where it is compressed into a vapor refrigerant. As the vapor refrigerant is compressed, it is forced through a condenser where the refrigerant is liquefied. The liquid refrigerant then passes through the evaporator where the liquid refrigerant is evaporated by absorbing heat from the object to be cooled. The mixed fluids then enter the electrochemical cell where hydrogen is reacted on a first electrode of the membrane electrode assembly to form protons that travel across a proton exchange membrane, and may form hydronium ions that are transported across the proton exchange membrane.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of his specification, illustrate embodiments of the invention, and together with the description serve to explain the principles of the invention.

DETAILED DESCRIPTION OF THE ILLUSTRATED EMBODIMENTS

Figure 1A:
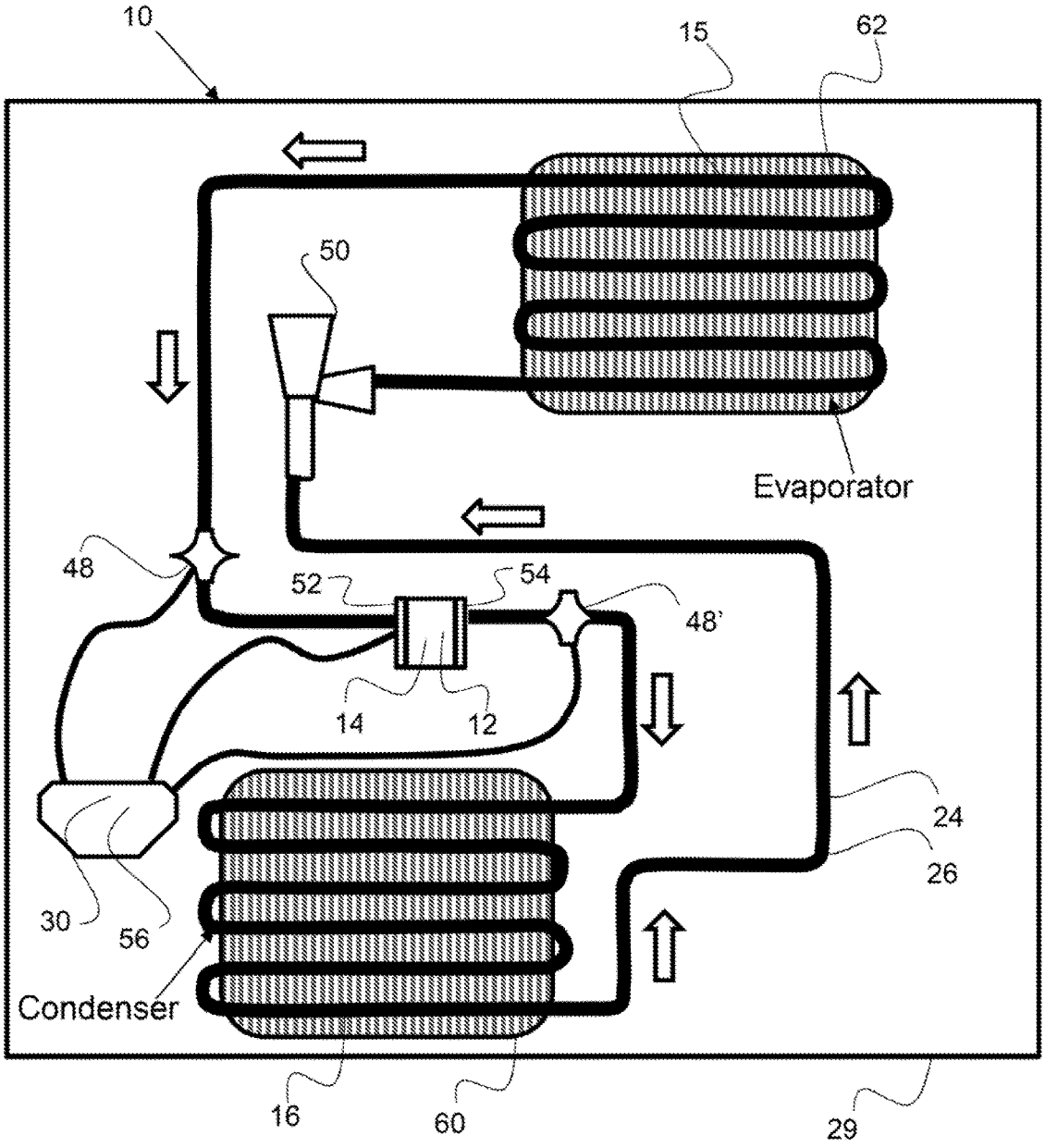

FIG. 1A shows a diagram of an exemplary electrochemical refrigeration system comprising a condenser, electrochemical compressor, an expansion valve and an evaporator.

Figure 1B:
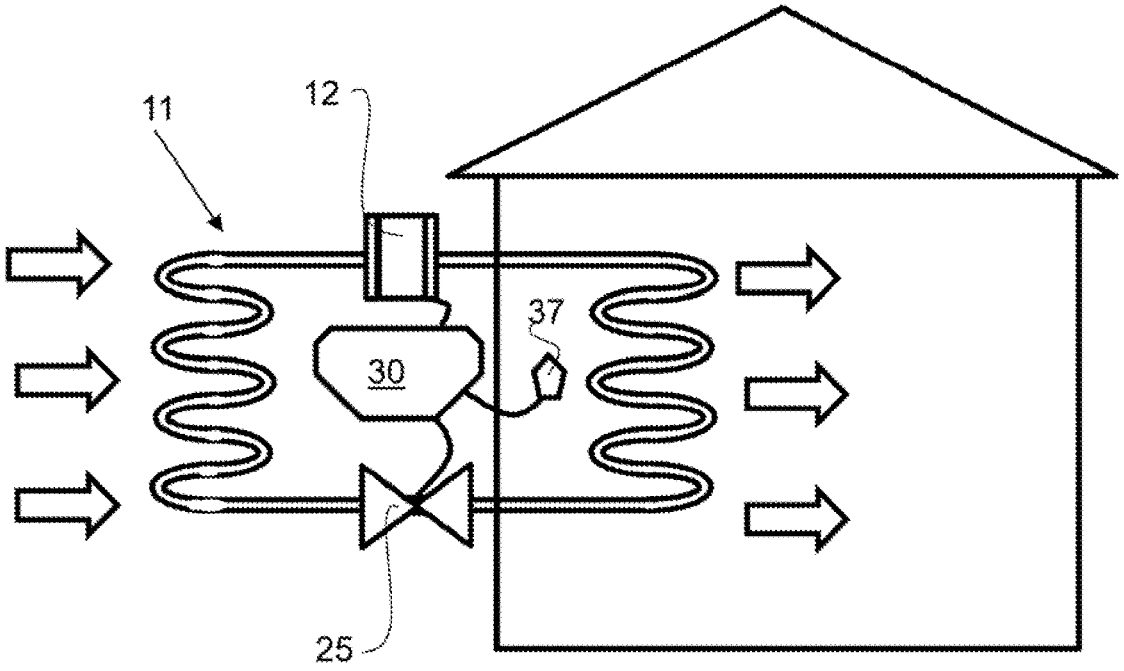

FIG. 1B shows a diagram of an exemplary electrochemical heat pump system.

Figure 2:
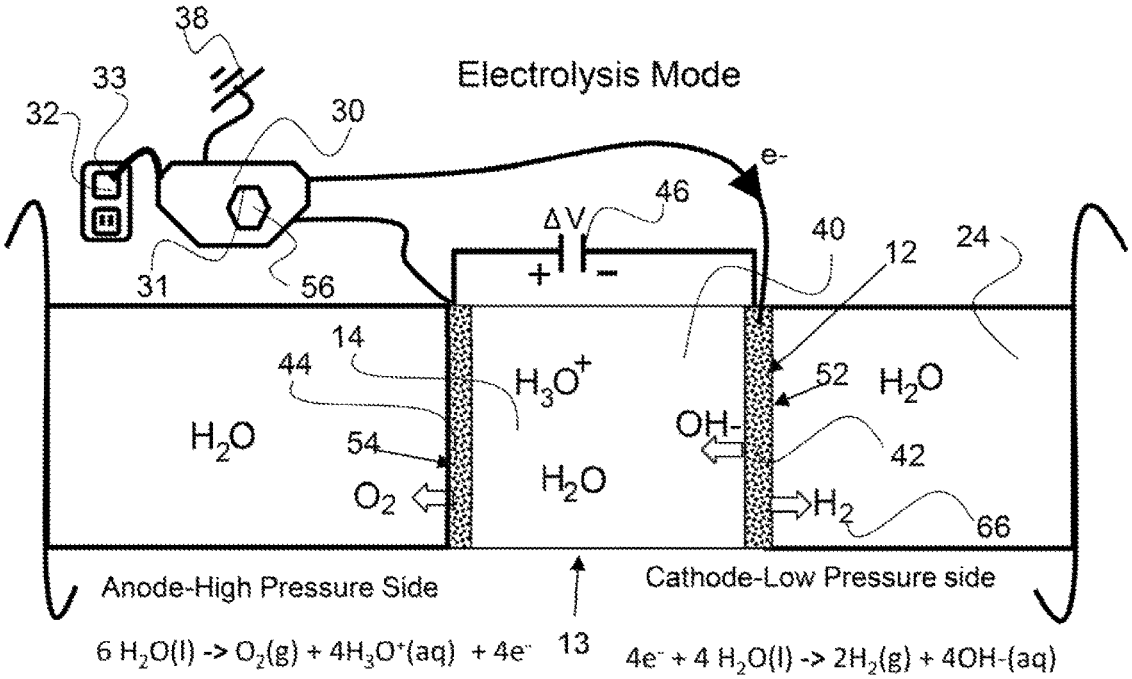

FIGS. 2 shows an exemplary electrochemical compressors operating in an electrolysis mode.

Figure 3:
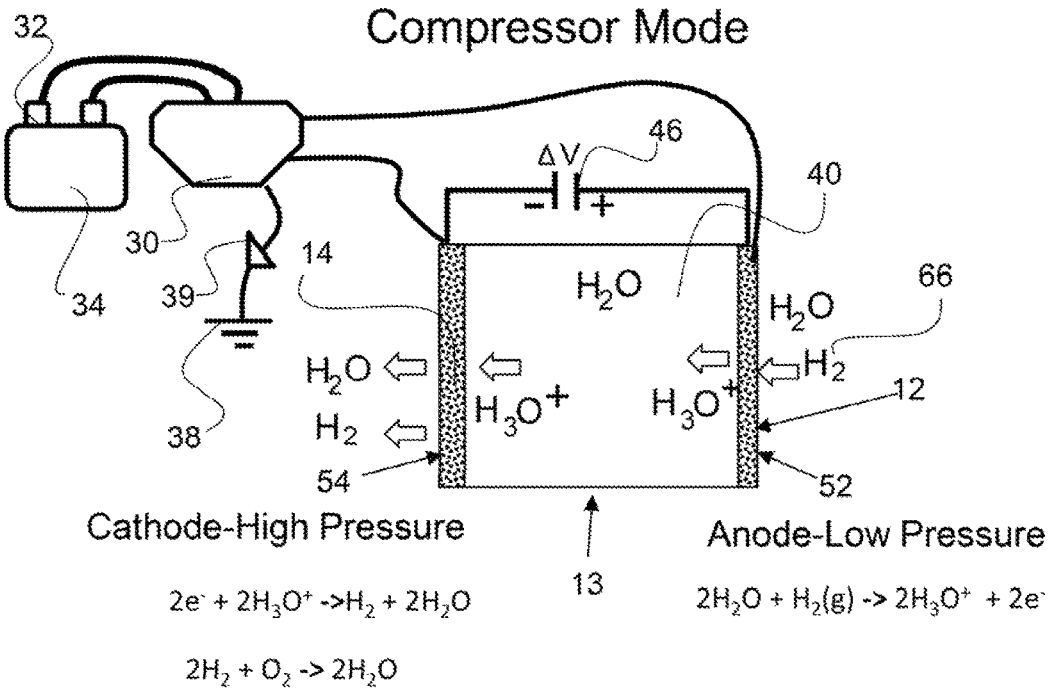

FIG. 3 shows an exemplary electrochemical compressors operating in a compressor mode.

Figure 4:
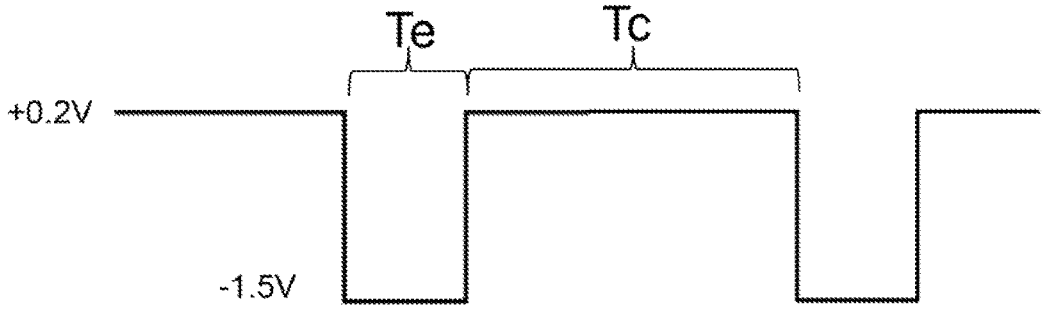
Figure 5:
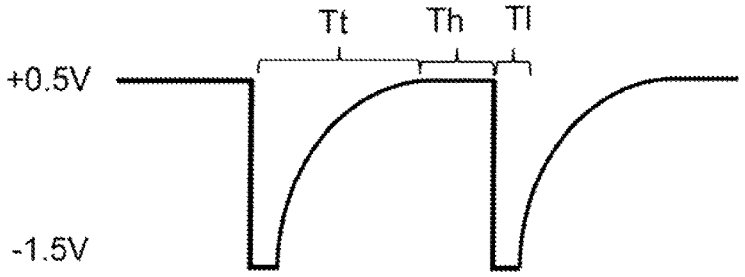
Figure 6:
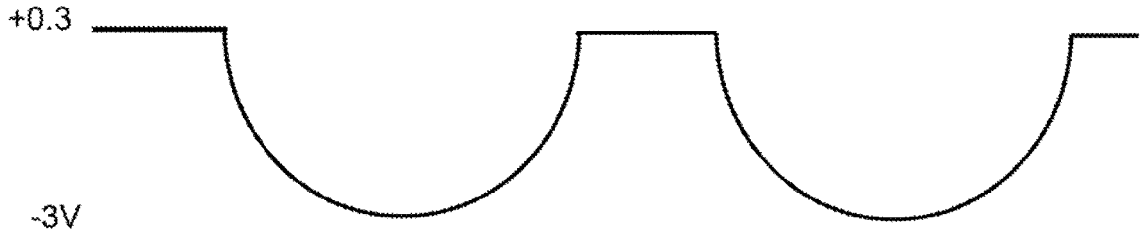

FIGS. 4, 5 and 6 show exemplary operating voltage waveforms.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1A, an exemplary electrochemical refrigeration system 10 comprises an electrochemical compressor 12 that utilizes a membrane electrode assembly 14. The membrane electrode assembly drives, or pumps, the working fluid across the cell as a function of the operating voltage controlled by the controller 30. The controller 30 may receive inputs from sensors 48, 48' such as pressure and/or flow and automatically change the operating voltage waveform in response to one or more sensor or user inputs. Sensor 48 is configured on the low pressure side 52 of the membrane electrochemical compressor 12 and sensor 48' is configured on the high pressure side 54 of the electrochemical compressor. The controller 30 may be coupled with any suitable power source be to control the operating voltage of the electrochemical compressor.

The working fluid passes 25 through conduits 24 that form a continuous loop around the electrochemical compressor and connect with the low pressure and high pressure sides of the electrochemical cell. The electrochemical compressor 12 raises the pressure of the working fluid and forces the working fluid to a condenser 16 where the condensable component is liquefied by heat exchange with a thermal or heat sink 60, such as an air or water heat exchanger. The working fluid is forced from the condenser to the expansion valve 50 where it is reduced in pressure by the thermal expansion. Subsequently, the predominantly liquid low pressure working fluid is delivered to an evaporator 15 where the condensed phase of the working fluid is boiled by heat exchange with a heat source 62, frequently an air heat exchanger or heat conductive plate depending on the application. The evaporator effluent working fluid may be partially in the gas phase and partially in the liquid phase when it is returned to the electrochemical compressor. In the process, heat energy is transported, from the evaporator to the condenser and consequently, from the heat source at low temperature to the heat sink at high temperature.

As shown in FIG. 1B, an exemplary electrochemical heat pump system 11 comprises an electrochemical compressor 12. The compressor can be used to drive a working fluid in either direction and a valve 25 may be configured to direct the flow depending the direction of flow desired. A controller 30 may be configured to control the operating voltage of the electrochemical compressor and therefore drive flow in either direction. The controller may also be coupled with the valve 25 and a temperature sensor 37 for a dwelling, for example.

In an exemplary embodiment, an electrochemical compression system, as described herein, is configured to modulate the electrochemical compressor 12 from an electrolysis mode to a compression mode as shown in FIG. 2 and FIG. 3, respectively. As shown in FIG. 2, the low pressure side 52 of the electrochemical compressor 12 receives current from the controller 30, as indicated the arrow on the electrical connection between the controller and the first electrode 42, to drive the potential down to an operating voltage that will initiate electrolysis. In the electrolysis mode, in situ hydrogen gas 66 is formed on the cathode, or first electrode 42 on the low pressure side 52 of the electrochemical compressor 12, and oxygen is formed on the anode, or second electrode 44 on the high pressure side 54. This in situ hydrogen 66 can subsequently be used in a compressor mode to drive water from the low pressure side 52 to the high pressure side 54, as shown in FIG. 3. The operating voltage, or voltage between the first and second electrodes may be changed by a controller to switch the electrochemical cell to a compressor mode. As seen in FIGS. 2 and 3, the potential across the MEA switches between the electrolysis mode and the compressor mode. In a compressor mode, the in situ hydrogen reacts on the first electrode 42 to produce protons. These protons, or hydronium ions produced therefrom, travel across the ion conducting membrane 40 as indicated by the large arrows in FIG. 3. The associated moisture shell of the protons (electro osmotic drag) will be transferred across the MEA from the low pressure side to the high pressure side. Careful control of the operating voltage, time at voltage and waveform, the level of hydrogen can be controlled in the system to increase the overall efficiency of the system.

The operating voltage 46, or voltage differential between the electrode on the low pressure side of the electrochemical cell, first electrode, and the electrode on the high pressure side of the electrochemical compressor, second electrode, is controlled by the controller and may be controlled by any suitable type of waveform. The controller may measure the operating voltage by measuring the voltage differential of the electrodes in the electrochemical cell and the absolute voltage of one or more of the electrodes in the electrochemical cell. The controller may control the operating voltage to be a waveform by providing or receiving electrical current from one or more of the electrodes. The controller is coupled with a power source to provide electrical current to the electrode for controlling the operating voltage. Any suitable power source may be utilized including a battery 34 or an electrical outlet 33. Any number of electrical switches 39 may be controlled by the controller to produce an operating voltage waveform. In the electrolysis mode, the operating voltage may be about −1.23V, or more negative such as about −1.5V, or about −3.0V and any range between and including the voltage values provided. The reactions at the first electrode 42 and second electrode 44, are shown in FIG. 2 and FIG. 3. In electrolysis mode, hydrogen and hydroxyl ions are produced on the first electrode and oxygen and hydronium ions are produced on the second electrode. The controller 30 is coupled with an electrical outlet 33 in FIG. 2 and is coupled with a battery 34 in FIG. 3. Any suitable power source 32 may be used however. The controller is coupled with an electrical ground 38 in FIGS. 2 and 3. The controller may control any number of electrical switches 39 to control the operating voltage 46 of the electrochemical cell 13.

As shown in FIG. 3, the electrochemical compressor 2 is operating in a compressor mode. The hydrogen produced in the electrolysis mode is reacted on the anode, or low pressure side, to form hydronium ions that are transported across the ion conducting membrane 40. The flow of hydronium ions and any associated water or working fluid that moves therewith increases the pressure on the high pressure side 54. Note that the anode and cathode switch sides between the electrolysis mode and compressor mode, as shown in FIG. 2 and FIG. 3. Hydrogen and oxygen may react on the high pressure side 54 to produce water in as shown in FIG. 3.

The production of in situ hydrogen, oxygen and hydronium ions enables higher efficiency of the electrochemical compressor system. The electrochemical compressor may control the rate of change and the time period or interval spent in each mode, between the electrolysis and compressor modes, as a function of the system requirements. A waveform of the operating voltage may be controlled as a function of sensor input. For example, a number of sensors may be configured to measure the pressure of the low pressure and high pressure sides of the electrochemical compressor and the waveform may be adjusted to maintain a pressure differential, or to increase or decrease pressure as desired.

A controller may control the operating voltage such that the operating voltage is a waveform. A control program 56, as shown in FIG. 2 may be loaded into the controller 30 and/or computing device 31 of the controller, and this control program may include one or more waveforms, or operating selections that a user may select depending on the application. A waveform, as used herein is defined as a periodic and repeating cycle of operating voltage. In one embodiment, the operating voltage may switch from a low voltage to a high voltage, such as from −1.5V to +0.2 volts, as shown in FIG. 4. As discussed for FIGS. 2 and 3, the voltage may be driven to less than −1.23V on the low pressure side to initiate the electrolysis of water. FIG. 4 shows a rectangular pulse waveform, wherein the voltage is abruptly changed from electrolysis mode at −1.5V to compressor mode at +0.2V. As shown in FIG. 4, the electrolysis time period or interval Te is much shorter than the compressor time interval Tc in this rectangular pulse waveform. As shown in FIG. 4, the operating voltage waveform transitions from an interval of time that the MEA operates in an electrolysis mode, Te, to an interval of time that the MEA operates in a compressor mode, Tc. The electrolysis time interval Te may be any suitable ratio to the compressor time interval Tc including, but not limited to, about 1.0 or less, 0.9 or less, about 0.5 or less, about 0.25 or less about 0.1 or less, about 0.05 or less and any range between and including the time interval ratios provided. The change in operating voltage from a low operating voltage set point to a high operating voltage set point may be any suitable amount, wherein the absolute change in voltage is more than 100%, such as when the operating voltage changes from −1.5 to +1.5, or may be a fractional change in value of about 80% or less, about 50% or less about 20% or less and the like.

In one embodiment, the operating voltage waveform may have a non-linear transition interval, Tt, over which time the operating voltage changes from a low value to a higher value, as shown in FIG. 5. The operating voltage may be changed from one polarity to another, as depicted in FIG. 5, wherein the operating voltage waveform switches from negative, −1.5V, to positive, +0.5V. The change in operating voltage may be abrupt, as shown in FIG. 4, non-linear, as shown as a decay transition in FIG. 5, linear, or in steps. As shown in FIG. 5, there is a high voltage time interval Th and a low operating voltage time interval TI of the operating voltage waveform.

The rate of change and time interval in each mode may be controlled to provide a high efficiency of compression as required by the system. FIGS. 4 to 6 show exemplary waveform operating voltages. FIG. 4 shows an exemplary waveform for the operating voltage, wherein the change from a low operating voltage to a high operating voltage is abrupt. The controller may change the operating voltage by providing an electrical current to the anode and/or cathode and/or by having electrical switches that allows the anode and/or cathode to be temporarily coupled with an electrical ground. The time interval for each mode, high, transition or low operating voltage, or the repeating time period of the waveform may be any suitable time interval, such as about less than 1 second, 5 second or more, about 10 seconds or more, about 30 seconds or more, about 5 minutes or more, about 10 minutes or more, about 30 minutes or more and any range between and including the time intervals listed. The electrolysis time interval may be any suitable ratio to the compressor time interval including, but not limited to, about 1.0 or less, 0.9 or less, about 0.5 or less, about 0.25 or less about 0.1 or less, about 0.05 or less and any range between and including the time interval ratios provided. The change in voltage from low voltage to high voltage may be any suitable amount, such as more than 100%, about 80% or less. about 50% or less, about 20% or less and the like.

The controller may provide any suitable type of waveform to the electrochemical compressor including a composite voltage waveform that consist of a series of negative voltage waveforms superimposed on a static positive voltage. The negative waveforms would be of such magnitude as to drive the system to electrolyze water to hydrogen at the low pressure side of the compressor for a relatively short enough duration such that the hydrogen generated remains in close proximity to the catalyst in the first electrode, so that it is oxidized when the voltage reverts to positive. Any suitable type of waveform may be used to control the operating voltage, or the operating voltage may be controlled to have any suitable waveform including a rectangular pulse wave, standard square wave, square wave with a decay back to positive, sine wave, or any complex waveform desired.

The ion conducting portion of the electrochemical compressor, or membrane electrode assembly may be an ionomer membrane. An exemplary electrochemical compressor utilizes an appropriate proton exchange membrane transport a proton from a low pressure side to a high pressure side of the electrochemical compressor. An exemplary proton exchange membrane, or ionomer membrane, such as a perfluorosulfonic-acid (PFSA) membrane, can absorb polar liquids, and transport ions through these liquids under an electric field. In an exemplary embodiment, a coexisting solvent, co-working fluid, such as water, methanol or any suitable ionic or polar solvent is transferred through the proton exchange membrane along with the proton. This co-working fluid can provide the appropriate vapor phase compressive cycle desired, from a region where there is a heat source, to a region where it can release thermal-energy efficiently. Its subsequent reintroduction to the heat-source region, where it can reabsorb more heat again, completes the refrigeration cycle. This cycle can employ a working fluid in a single state (such as hydrogen, entirely in gas-phase) or can engage a working fluid that comprises an electro-active component and a co-working fluid. Hydrogen may be the electro-active component and water, methanol, or any other suitable ionic or polar solvent may be the co-working fluid, for example. A co-working fluid may change state as it passes through the refrigeration cycle, from gas to liquid, as a refrigerant does, in a traditional refrigeration cycle.

In an exemplary embodiment, the proton exchange membrane is a PFSA membrane, sold as Nafion®, Dupont Inc., Newark, Del., which is a synthetic polymer with ionic properties. Nafion's unique ionic properties result from incorporating perfluorovinyl ether groups terminated with sultanate groups onto a tetrafluoroethylene backbone. Membranes utilizing PFSA ionomer have received considerable attention as proton conductors for polymer electrolyte membrane (PEM) fuel cells because of their thermal and mechanical stability. This combination of physical stability and ionic conduction enables these membranes to be suitable for these devices. In a fuel cell, protons, on the sulfonic acid groups, hop from one acid site to another. Pores allow movement of cations within a polar layer, typically water imbibed in the membrane. A critical requirement of these cells is to maintain a high water, or polar-liquid, content in the electrolyte. This ensures high ionic conductivity. The ionic conductivity of the proton exchange membrane is higher when the membrane is fully-saturated which offers a low resistance to current flow and increases overall efficiency. It may be desirable to maintain a sufficient relative humidity as the current density is increased when the relative humidity is increased in the incoming gas steam of a membrane electrode assembly. Contributing factors to water, or polar-liquid transport, are: water-drag through the cell; back diffusion from the cathode; and diffusion of any polar-liquid in the fuel stream through the electrode Liquid transport across a membrane electrode assembly may be a function of cell current and the characteristics of membranes and electrodes. Liquid drag refers to the amount of a polar component pulled by osmotic action along, with the proton. Between 1 and 2.5 molecules are dragged with each proton. As a result, the ion exchanged can be envisioned as a hydrated proton, H (H2O)n+. Drag that potentially increases at higher current density as more protons are transported across the membrane. In effect, the hydrated proton migrates from one electrode to the other under an electric field, within a sea of polar-liquid (ie. water and/or methanol combined). An exemplary proton exchange membrane may require high rates of hydration with both water and/or methanol. Hydration rates can be increased by increasing the number of sulfonic acid groups within the membrane, sometimes referred to as a decrease in equivalent weight (EW). Equivalent weight refers to the molecular weight of the ionomer for each sulfonic acid group and may be about 1200 or less, about 1000 or less, about 900 or less, about 800 or less, and any range between and including the equivalent weights provided. In an exemplary embodiment, a proton exchange membrane having an equivalent weight of 800 or less is utilized.

The ionomers used may extend to the many water soluble ionomers. Two commercially available materials examples include : Poly styrene sulfonic acid (PSSA) and carboxymethyl cellulose (CMC). They are not only much less expensive than PFSA ionomer, but also have lower EW, such as about 200, and therefore are more conductive and can thus allow the system to operate at higher current densities. Poly styrene sulfonic acid (PSSA) is available from Aldrich: PSSA as 18% solution of the free acid in H2O; and as a 30% solution of the NH4+ salt. This ionomer is the non-cross-linked version of conventional ion exchange resins. carboxymethyl cellulose is available at 250000 MW and DS=1.2 and available in the Na+ salt form. This can also be converted to the free acid or NH4+ salt. Note that many ionomers can be readily mixed with each other in various ratios to combine properties such as for example PSSA with NAFION and then converted to membranes. The examples above are merely illustrations, should not be considered limitations in anyway.

Generally ionomer can be film cast to establish membranes. Casting methods do generally provide different physical properties. Typically thin films of ionomer can be brittle and/or mud crack: thus it is preferred that they be dissolved in methanol and recast. Films can be cast on glass, both CMC and PSSA do not release easily from glass. Optionally, films can be cast on non-stick surfaces such as polytetrafluoroethylene (PTFE), fluorinated ethylene propylene (FEP) or polyolefin films. Another option is to cast the films within the matrix of a porous membrane such as a very open, porous structure of expanded PTFE (with interconnected nodes and fibrils) or another porous media such as polyethylene membrane or polyester substrate. A fibrous medium such as fiberglass, ceramic fiber or polymer fiber can also be suitable. Additionally, the ionomer can be cast with fiber reinforcement in the solution such as fiber glass, or PTFE fiber, or polymeric fiber or ceramic fiber etc. In essence the idea is to reinforce the ionomer before assembly and/or during operation when solvated. Thinner membranes reduce the distance ions need to travel and as a result enhance performance. Reinforcing the membrane allows for ultra-thin membranes to be formed well below 25 microns in thickness or indeed 10 microns in thickness and ultimately less than one micron in thickness. Thus this invention does not envision any thickness limitations. The examples above are merely illustrations, should not be considered limitations in anyway.

Note that depending on what ionomer or ionomers are used, similar or at least compatible ionomers need to be used as binder with catalyst in the electrode for the membrane electrode assembly. Such electrode 'inks' can be sprayed onto the membrane or printed onto the membrane or a suitable substrate or even cast and then pressed against the membrane with assured bonding. The examples above are merely illustrations, should not be considered limitations in anyway. Optionally, different ionomer(s) and/or blends may be used for different sides of the MEA. The examples above are merely illustrations, should not be considered limitations in anyway.

An electrochemical cell, with the components identified above relay form an the working portion of an electrochemical compressor device. An electrochemical compressor device, as described herein, may be utilized in a variety of different refrigeration cycles including, a refrigerator, or heat pump, or automobile, or electronic cooling application.

While the example provided involved protons with water as a working fluid (both for electrolysis and compression), this same novel approach can be utilized for a number of different electrochemical compressor systems with other working fluids and ions, such as without limitation working fluids like ammonia, carbon dioxide, etc. and hydroxyl ions, ammonium ions etc. Utilizing both cationic and anionic electrolytic systems. Clearly the polarity, magnitude, pattern of the waveform and the frequency of change in waveform pattern needs to be optimized for the specific ionic, electrolytic and working fluids involved.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A method of heat transfer comprising the steps of:

a. providing an electrochemical compression system comprising:

i. an electrochemical cell comprising:

a membrane electrode assembly comprising:

a low pressure side;

a high pressure side;

a first electrode on the low pressure side;

a second electrode on a high pressure side:

proton exchange membrane;

wherein the proton exchange membrane is configured between the first and second electrodes; and wherein the electrochemical cell has an operating voltage across the first and second electrodes:

ii. a working fluid comprising:

an electro-active component comprising hydrogen;

a co-working fluid;

iii. a controller coupled with the electrochemical and also coupled with a power supply, whereby the controller controls the operating voltage and wherein the operating voltage is a waveform;

iv. a continuous conduit coupling the low pressure side to the high pressure side;

whereby said working fluid flows through said conduit;

v. a condenser in-line with said conduit to receive said working fluid from the high pressure side of the electrochemical cell; and vi. an evaporator figured in-line with said conduit to receive said working fluid from said condenser;

b. operating the electrochemical cell in an electrolysis mode for an electrolysis time interval of the operating voltage waveform, wherein the operating voltage is more negative than −1.23V and a plurality of in situ hydrogen is produced on the low pressure side; and wherein hydrogen and hydroxyl ions are produced on the first electrode and oxygen and hydronium ions are produced on the second electrode;

c. subsequently operating the electrochemical cell in a compressor mode for a compressor time interval of the operating voltage waveform;

whereby the operating voltage is more than 0.01V; and reacting said plurality of in situ hydrogen on the first electrode to produce a plurality of hydronium ions;

d. transferring said hydronium ions across the proton exchange membrane to increase the pressure on the high pressure side;

e. forcing the working fluid through said conduit from the high pressure side to the condenser wherein the working fluid is compressed to generate a heat that is exchanged with a heat sink;

f. forcing the working fluid from the condenser to the evaporator wherein the pressure of the working fluid is reduced and whereby heat is exchanged with a heat source.

2. The method of heat transfer of claim 1, wherein the operating voltage is −1.5 or more negative when operating in electrolysis mode.

3. The method of heat transfer of claim 2, wherein the proton exchange membrane comprises perfluorosulfonic acid polymer.

4. The method of heat transfer of claim 1, wherein the step of providing an electrochemical compression system further comprises providing a control program of the controller, wherein the controller automatically controls the operating waveform by the control program.

5. The method of heat transfer of claim 4, wherein the step of providing an electrochemical compression system further comprises providing a pressure sensor configured to measure a pressure within the conduit and coupled with the controller to provide a pressure input reading, and wherein the controller automatically controls the operating waveform by the control program and as a function of the sensor pressure input.

* * * * *